United States Patent [19]

Coppola et al.

[11] Patent Number: 4,585,205

[45] Date of Patent: Apr. 29, 1986

[54] FAST OPENING VALVE APPARATUS

[75] Inventors: Patrick S. Coppola; Paul E. Malone, both of Schenectady, N.Y.

[73] Assignee: General Electric Company, Schenectady, N.Y.

[21] Appl. No.: 620,351

[22] Filed: Jun. 13, 1984

[51] Int. Cl.[4] ..... F16K 31/363

[52] U.S. Cl. ..... 251/26; 60/652; 91/27; 91/31; 91/361; 91/363 R; 91/363 A

[58] Field of Search ..... 91/27, 31, 361, 363 A, 91/358 R, 358 A, 363 R; 251/26; 60/652

[56] References Cited

U.S. PATENT DOCUMENTS

| | | | |
|---|---|---|---|
| 3,097,488 | 7/1963 | Eggenberger et al. | 60/73 |
| 3,495,501 | 2/1970 | Kure-Jensen | 91/440 |
| 4,040,600 | 8/1977 | Coppola et al. | 251/63 |
| 4,065,094 | 12/1977 | Adams | 251/26 |
| 4,121,618 | 10/1978 | Sweeney | 137/412 |
| 4,215,844 | 8/1980 | Bowen | 251/28 |

*Primary Examiner*—Samuel Scott

*Assistant Examiner*—Allen J. Flanigan

*Attorney, Agent, or Firm*—Paul Checkovich; Jerome C. Squillaro

[57] ABSTRACT

A fast opening valve apparatus includes an electronic sensing circuit to determine when a positional error signal exceeds a predetermined reference value corresponding to an opening rate reference value. The sensing circuit provides a fast open command signal which is applied to a solenoid valve which is hydraulically coupled in parallel with a control servo valve. The control servo valve hydraulically couples a primary source of hydraulic fluid under pressure to a valve actuator which is mechanically coupled to a valve stem of an associated steam valve desired to be controlled. The activated solenoid valve opens a supplemental hydraulic fluid path between the valve actuator and the primary source of hydraulic fluid. To ensure an adequate hydraulic fluid pressure at the input of the servo valve and solenoid valve, an auxiliary source of hydraulic fluid under pressure may be coupled upstream of the servo valve and solenoid valve.

6 Claims, 4 Drawing Figures

FAST OPENING VALVE APPARATUS

BACKGROUND OF THE INVENTION

This invention relates generally to a valve actuator for a steam valve, and particularly to a fast opening apparatus for the valve actuator.

It is common for a number of mechanically coupled steam turbines to provide mechanical power to the rotor of an electromagnetic generator. In such a system, it is desirable to match the combined mechanical output from the steam turbines with the generator's electrical output to the load or user. In some situations, switching transients on the long-distance transmission lines from the electric power plant affect the load and, hence, change the mechanical power requirements for the rotor of the electromagnetic generator. Since a majority of the mechanical power developed by the plurality of coupled steam turbines is developed by the low pressure steam turbines (in contrast to the high pressure and intermediate pressure steam turbines), one method of quickly changing to different power levels involves utilization of an intercept valve fluidly coupled between the intermediate pressure turbine and the low pressure turbine. Generally, the intercept valve is maintained in an open position such that steam exiting the intermediate pressure turbine flows through the intercept valve to inlets of the low pressure turbine via appropriate steam admission valves. A detailed description of such an intercept valve is found in U.S. Pat. No. 3,495,501 by Kure-Jensen, which is incorporated herein by reference thereto. Simply stated, the intercept valve, which is normally open, rapidly closes to cut off steam flow between the intermediate pressure turbine and the low pressure turbine. It is to be recognized that a plurality of turbines, valves, and associated mechanical and electrical elements are included in a steam turbine electrical generation plant. However, for simplicity, only one valve will be discussed herein with reference to the present invention.

Rapid closure of the intercept valve is accomplished by rapid activation of a valve actuator mechanically connected to the valve stem of the intercept valve. In U.S. Pat. No. 3,495,501 by Kure-Jensen, the valve actuator includes a disc dump valve. The disc dump valve includes a sealing member disposed between a port in the actuator chamber and an output channel which is hydraulically coupled to a drain. The sealing member is biased against the chamber port by a spring means and by fluid pressure. Rapid closure of the valve actuator, and hence the steam valve, is accomplished by the fluid pressure and subsequently hydraulically linking the chamber port with the output port. Experimentally, steam valve actuators have been closed within approximately 0.1 seconds.

It is desirable not only to achieve rapid closure of steam valves but also rapid opening of those valves. One problem is to supply enough hydraulic fluid flow to the actuator chamber to achieve rapid opening of the steam valve. Limitations on hydraulic fluid flow supplied to the actuator chamber are sometimes caused by the control servo valve which couples a primary source of hydraulic fluid under pressure with the valve actuator chamber. Also, inability of the primary source of hydraulic fluid under all operating conditions to maintain adequate fluid pressure in the supply lines to the valve actuator as well as to the balance of the hydraulic control system may limit rapid opening of the valve actuator. It is appreciated by a person or ordinary skill in the art that hydraulic fluid under pressure is utilized extensively throughout the turbine plant to control the plurality of steam valves and hence steam turbine operation.

OBJECTS OF THE INVENTION

It is an object of the invention to provide an apparatus and method for rapid opening of a valve actuator mechanically coupled to a steam valve.

It is another object of the invention to achieve such rapid opening without significantly affecting the balance of the hydraulic control system coupled to a source of hydraulic fluid under pressure.

It is a further object of the invention to combine this rapid opening feature with a fast closing feature integrated with the valve actuator.

It is an additional object of the invention to achieve this rapid opening feature utilizing a plurality of available valves in combination with electronic circuitry.

SUMMARY OF THE INVENTION

A fast opening valve means, in one embodiment, includes an electronic sensing circuit to determine when a control error signal exceeds a signal reference value. The control error signal is the difference signal between a steam flow demand control signal and a position feedback signal from a valve actuator, the position feed back signal representative of the position of the valve stem of a steam valve. A control servo valve hydraulically couples a source of hydraulic fluid under pressure via a primary supply line to the valve actuator. The valve actuator responds to increased hydraulic fluid flow supplied thereto by moving the valve stem and steam valve in an open direction. The sensing circuit provides a fast open command signal when the control error signal exceeds a predetermined reference signal. The fast opening valve means includes a first valve means, which in one embodiment is a two-stage solenoid valve, hydraulically coupled in parallel with the control servo valve. The first valve means opens a supplemental supply line between the valve actuator and source of hydraulic fluid via a primary supply line upon receipt of the fast open command signal. To ensure adequate hydraulic fluid at the juncture between the primary supply line and the supplemental supply line, an auxiliary source of hydraulic fluid under pressure is coupled upstream of that juncture. As used herein, the term "upstream" refers to a component's position relative to flow of hydraulic fluid vis-a-vis another component. Additionally, the fast opening valve means may include electrical circuits providing a positional stop command signal which isolates the fast open command signal from the first valve means when the valve actuator reaches or exceeds a predetermined position. The fast opening valve means may also include means for limiting the control error signal to a first or a second magnitude dependent upon the presence or absence of the fast open command signal and the positional stop command signal.

BRIEF DESCRIPTION OF THE DRAWING

The subject matter which is regarded as the invention is particularly pointed out and distinctly claimed in the concluding portion of the specification. The invention, however, together with further objects and advantages thereof, may best be understood by reference to the following description taken in connection with the accompanying drawing in which:

DETAILED DESCRIPTION

The present invention relates generally to a fast opening apparatus integrated with a valve actuator which mechanically positions a valve stem of a steam valve.

Figure 1:
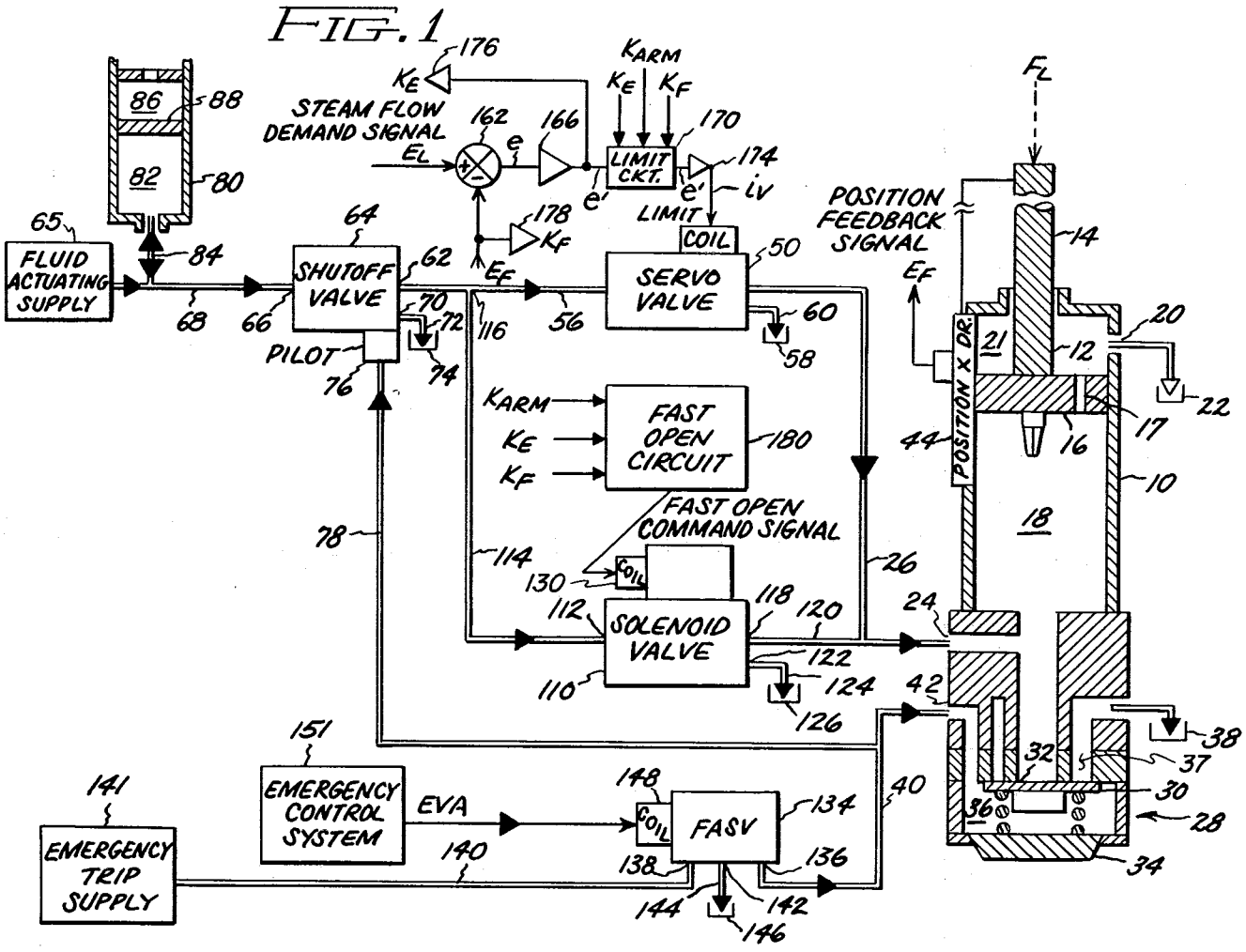
FIG. 1 is a schematic representation of a valve actuator and associated hydraulic and electrical systems, in accordance with one embodiment of the present invention.

FIG. 1 illustrates, in schematic form, one embodiment showing mechanical, hydraulic and electrical aspects of the present invention. Hydraulic fluid paths are generally illustrated as a closely spaced pair of lines, electrical connections are shown as single lines, mechanical aspects are primarily crosshatched, and functional blocks detail certain components in this embodiment.

An actuator 10 includes a reciprocating piston 12. A piston rod 14 of piston 12 may be mechanically coupled to a valve stem of a steam or intercept valve (not shown) for controlling the rate of flow of steam through the steam valve. A force $F_L$ acts upon piston rod 14 in the direction illustrated by the dotted line and arrow in FIG. 1. Force $F_L$ represents the action of the steam valve and springs or mechanical devices biasing the valve stem in a particular direction. A piston head 16 and portions of piston rod 14 reciprocate within an actuator chamber 18. Drain port 20 hydraulically couples a top portion 21 of chamber 18 with a drain or sump 22. A small channel 17 extending entirely through piston head 16 may be provided. Channel 17 permits hydraulic fluid communication between chamber 18 and top portion 21 of chamber 18. Hydraulic fluid in top portion 21 may flow to a sump 22 through a port 20 of actuator 10. Hydraulic fluid flow through channel 17 into portion 21 keeps hydraulic fluid from overheating in chamber 18, since cooler fresh fluid through port 24 is required to replace fluid removed from chamber 18 through channel 17 in order to maintain piston 12 at the desired position within chamber 18. In addition, hydraulic fluid flow through channel 17 prevents hydraulic fluid within chamber 18 from stagnating, such that air pockets may be likely to form within chamber 18. Both cooling and preventing stagnation of hydraulic fluid within chamber 18 may be especially required during long intervals when piston 12 is up to maintain the associated steam valve open. Drainage means such as port 20 coupled to sump 22 would generally be required even if no hydraulic fluid flow path were provided through piston head 16, since typically some hydraulic fluid will leak past the seal between piston head 16 and the inner wall of chamber 18.

It is to be recognized that, when valve actuator 10 moves rod 14 in an upward direction such movement corresponds to the opening of the mechanically coupled steam valve (not shown). As can be readily recognized, an increased fluid flow into chamber 18 acts on the face of piston head 16 to move piston 12 upward and thereby opening the associated steam valve. In another sense, a downward motion of piston 12 corresponds to closure of the steam valve. It is to be understood that directional terms such as top, bottom, upward, downward, are used for convenience and ease of explanation and are not intended to limit the actual physical orientation of components of the present invention.

A fluid inlet port 24 of actuator 10 hydraulically couples chamber 18 with a hydraulic line 26. Valve actuator 10 also includes a fast closing means for rapid positioning of the valve stem and steam valve to a closed position, i.e., rapid descent of piston 12 in chamber 18. The fast closing means includes a disc dump valve 28 directly connected with actuator 10. A description of the fast closing means is noted in U.S. Pat. No. 3,495,501, by Kure-Jensen, which is incorporated herein by reference thereto. As illustrated in FIG. 1, disc dump valve 28 includes a disc 30 sealingly biased against a port 32 of chamber 18. Disc 30 is sealingly biased against port 32 by a spring 34 and by fluid pressure in a chamber 36. A circumferential discharge channel 37 is also sealed by disc 30 when biased against port 32. Discharge channel 37 is hydraulically coupled to a drain 38. Hydraulic fluid pressure in chamber 36 is directly affected by the fluid pressure in hydraulic line 40 via port 42 which provides communication between line 40 and chamber 36.

A position feedback signal $E_F$, indicative of the position of piston 12 within chamber 18, which in turn corresponds to the position of the valve stem and associated steam valves, is generated by a position transducer 44 which is labeled "Position XDR." Position transducer 44 may be a linearly variable differential transformer as recognized by persons or ordinary skill in the art.

During intervals not requiring rapid positioning of the associated steam valve, valve actuator 10 generally responds to hydraulic fluid flow supplied to port 24 through a control servo valve 50 which is hydraulically coupled to port 24 by hydraulic line 26. Servo valve 50 may comprise a high flow servo valve which, in one embodiment, is manifolded to actuator 10. The schematic of FIG. 1 does not illustrate this manifold feature but a person of ordinary skill in the art recognizes the benefits of such a feature. Fluid flow through servo valve 50 is controlled by a control signal current $i_V$ applied to a servo valve coil 52 of servo valve 50. Hydraulic fluid under pressure is supplied to servo valve 50 from an output port 62 of a shutoff valve 64 through a hydraulic line 56. Fluid flow may be discharged from servo valve 50 to a drain 58 by way of hydraulic discharge line 60. In one embodiment, the gain of servo valve 50 is about 15 cubic inches per second per milliamp.

An input port 66 of shutoff valve 64 is hydraulically coupled through a primary supply line 68 to a source 65 (designated fluid actuator supply) of hydraulic fluid under pressure. Shutoff valve 64, in one embodiment, may comprise the shutoff valve described in U.S. Pat. No. 4,040,600 by Coppola et al. and that disclosure is incorporated herein by reference thereto. Shutoff valve 64 includes a drain port 70 hydraulically coupled to drain 74 through a discharge line 72. Shutoff valve 64 is controlled by a pilot switch 76 which is fluidly connected to an output port 136 of a fast acting solenoid valve (FASV) 134 through a hydraulic line 78. Typically, shutoff valve 64 operates either fully open or fully closed i.e., fluid flow from port 66 to port 62 permitted or blocked, respectively. In contrast, servo valve 50 provides continuous control of hydraulic fluid flow on line 26 over a wide range of values as determined by control current signal $i_v$. The operating condition, i.e., open or closed, of shutoff valve 64 respectively depends upon the presence or absence of hydraulic fluid under sufficient pressure, respectively, in line 78 affecting pilot switch 76. In the absence of sufficient hydraulic pressure on line 78, pilot 76 causes shutoff valve 64 to prohibit flow of fluid therethrough. In another sense, fluid can flow from primary supply line 68 through port 66 and port 62 and into hydraulic line 56 as long as sufficient hydraulic fluid pressure is maintained in hydraulic line 78.

The fast opening valve means of the present invention includes an auxiliary source 80 of hydraulic fluid under pressure such as a fluid accumulator. Fluid accumulator 80 includes a first chamber 82 hydraulically coupled via a hydraulic line 84 to primary supply line 68. Accumulator 80 also includes a second chamber 86. Second chamber 86 is isolated from ambient environment and typically contains a gas under pressure. A reciprocating sealing member 88 separates chamber 82 from chamber 86. Sealing member 88 reciprocates within accumulator 80. Therefore, positioning of sealing member 88 is dependent upon equalization of forces between chamber 82 and 86. Since chamber 82 is hydraulically coupled via line 84 to primary supply line 68 and fluid actuator supply 65 supplies hydraulic fluid at its output at a predetermined pressure, the gas in chamber 86 must equal the pressure of fluid provided by supply 65 assuming the area affected by the fluid in chamber 82 and the gas in chamber 86 is equal.

The fast opening valve means includes a valve means 110, such as solenoid valve. An inlet port 112 of solenoid valve 110 is hydraulically coupled to a first supplemental supply line 114. Supplemental supply line 114 is hyraulically coupled to line 56 at a juncture 116. Juncture 116 is between shutoff valve 64 and servo valve 50. An outlet port 118 of solenoid valve 110 is hydraulically coupled to a second supplemental supply line 120. Supplemental supply line 120 is hydraulically coupled to line 26 and port 24 of actuator 10. Therefore, valve 110 and lines 114 and 120 are hydraulically coupled in parallel with valve 50 and lines 56 and 26. Solenoid valve 110 also includes a discharge port 122 hydraulically linked to a drain 126 through a discharge line 124. Solenoid valve 110 may comprise a high flow two-stage solenoid valve manifolded to actuator 10. Again, the schematic in FIG. 1 does not illustrate this manifold feature, but a person of ordinary skill in the art recognizes the benefits of such feature. Solenoid valve 110 is actuated by a coil 130 which is electrically coupled to an output of a fast open circuit 180. Generally, solenoid valve 110 only allows full fluid flow between ports 112 and 118 or substantially no fluid flow therethrough, dependent upon the presence or absence of a fast open command signal applied to coil 130, respectively.

The fast closing feature of this embodiment of the present invention includes a fast acting solenoid valve (FASV) 134 fluidly coupled from an output port 136 to port 42 of actuator 10 through hydraulic line 40. Valve 134 includes port 138 hydraulically coupled to a second source 141 of hydrauiic fluid under pressure (designated as the emergency trip supply) through a secondary supply line 140. Valve 134 includes a discharge port 142 hydraulically coupled to drain 146 through discharge line 144. Valve 134 is actuated by a coil 148 which is electrically coupled to an output emergency control system 151 which supplies an early valve actuating (EVA) signal to coil 148. As stated earlier, a detailed description of the fast closing feature of the present invention is provided in U.S. Pat. No. 3,495,501.

The electrical system schematically illustrated in FIG. 1 may be, in one embodiment, part of an electrohydraulic turbine control system described in U.S. Pat. No. 3,097,488 by Eggenberger et al. and further include additional components and features to accomplish the fast opening aspect of the present invention. The disclosure in U.S. Pat. No. 3,097,488 is incorporated herein by reference thereto. A steam flow demand signal $E_L$ is applied to one input of a subtractor 162 and position feedback signal $E_F$ from the output of position XDR 44 is applied to another input of subtractor 162. A difference signal e representing the difference in magnitude between steam flow demand signal $E_L$ and position feedback signal $E_F$ is generated by subtractor 162. It is to be recognized that device 162 may be an adder with one of the input signals (either $E_L$ or $E_F$) inverted before being supplied to the adder. In another sense, device 162 could be a means for subtracting demand signal $E_L$ from position feedback signal $E_F$. In any event, a positional error signal e is generated and available at the output of subtractor 162. The output of subtractor 162 is coupled to the input of amplifier 166. Amplifier 166 amplifies and modifies positional error signal e to generate a further positional error signal e' available at the output of amplifier 166. Error signal e' is applied to an input of a limit circuit 170 which generates a limited positional signal $e_{LIMIT}'$. The limited positional signal $e_{LIMIT}'$ is applied to a servo driver amplifier 174 which generates a control error signal in the form of a control current $i_V$ which is supplied to coil 52 of servo valve 50.

The fast opening valve means of the present invention includes comparator means 176 for determining when the further positional error signal e' exceeds a predetermined reference signal value. Comparator means 176 generates a command signal affecting a relay KE (not shown in FIG. 1). The input of comparator 176 is coupled to the output of amplifier 166 and comparator 176 senses the voltage level of the further positional error signal e'. In this embodiment of the present invention, the input of comparator means 178 for comparing the position feedback signal with a predetermined positional feedback reference signal value is coupled to the output of position XDR 44. Comparator means 178 generates a command signal affecting a relay KF (not shown in FIG. 1). The command signal outputs of comparator 176 and 178 for relays KE and KF respectively are also provided to respective inputs of limit circuit 170 and of a fast open circuit 180, respectively. Another command signal KARM is provided as an input to limit circuit 170 and fast open circuit 180.

Figure 2:
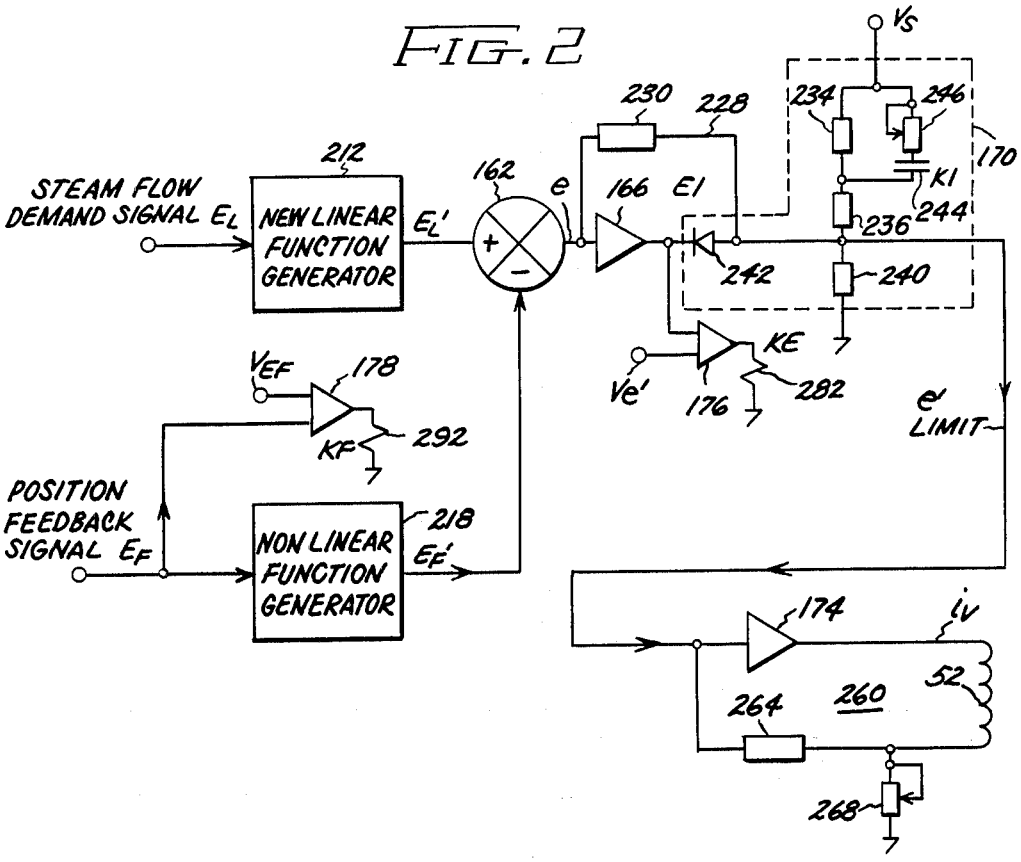
FIG. 2 is a more detailed schematic representation of the electrical portion of the embodiment of FIG. 1 in block diagram form.
Figure 3A:
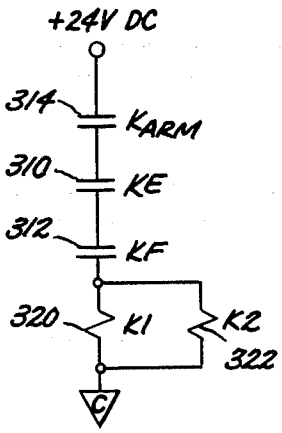
FIGS. 3*a* and 3*b* illustrate switching and relay circuitry as part of the fast open circuit logic of the present invention.
Figure 3B:
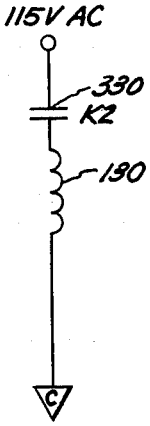

FIGS. 2, 3*a* and 3*b* illustrate electrical elements of an embodiment of this invention. Steam flow demand signal $E_L$ is applied to an input of a nonlinear function generator 212. Function generator 212 modifies steam flow demand signal $E_L$ such that a resultant modified steam flow demand signal $E_L'$, available at the output of function generator 212, is corrected for nonlinear steam flow through the steam valve to be controlled by actuator 10 (FIG. 1). A detailed description of function generator 212 is provided in U.S. Pat. No. 3,097,488 by Eggenberger et al. discussed hereinabove. Position feedback signal $E_F$ is applied to an input of a nonlinear function generator 218. Function generator 218 converts position feedback signal $E_F$ to a modified position feedback signal $E_F'$ which reflects the nonlinear fluid flow through the steam valve to be controlled by actuator 10 (FIG. 1). Again, U.S. Pat. No. 3,097,488 by Eggenberger et al. provides a detailed description of function generator 218 and a control loop for steam valves. Modified position feedback signal $E_F'$ and modified steam flow demand signal $E_L'$ are supplied to subtractor 162. Positional error signal e is the difference signal between modified steam flow demand signal $E_L'$ and modified position feedback signal $E_F'$. Positional error signal e is applied to an input of amplifier 166 which generates further positional error signal e', available at the output of amplifier 166. A feedback loop including a resistor and/or filter network 230 is coupled to the input of amplifier 166 and to the output of amplifier 166 through a diode 242. The feedback loop establishes the gain of amplifier 166.

This embodiment of the present invention includes a limiting circuit 170 which is supplied with a voltage $V_s$. Limiting circuit 170 limits the magnitude of a limited positional error signal $e_{LIMIT}'$ which is generated from positional error signal e' and is available at the anode of diode 242. Limiter 170 includes series connected resistance means 234 and 236 electrically coupling voltage supply $V_s$ to the anode of diode 242. The anode of diode 242 is connected to ground potential through resistance means 240. The cathode of diode 242 is connected to the output of amplifier 166. Series connected variable resistance means 246 and switching means 244 (which is part of a relay K1) are connected in parallel with resistance means 234.

In operation, limiter circuit 170 limits the maximum magnitude of further positional error signal e' to a selectable one of two magnitudes in accordance with well known electrical principles to generate limited positional error signal $e_{LIMIT}'$. When switching means 244 (as part of relay K1) is closed, limit circuit 170 substitutes a larger magnitude signal as a limit for signal e'. In other words, further positional error signal e' is limited to a first magnitude when relay K1 is not activated and switching means 244 is open, and further positional error signal e' is limited to a second magnitude when relay K1 is activated and switching means 244 is closed. The second magnitude is larger than the first magnitude.

Limited positional error signal $e_{LIMIT}'$ is applied to a servo valve control loop 260. Loop 260 includes amplifier 174 which generates control current $i_V$ corresponding to the level of voltage of limited positional error signal $e_{LIMIT}'$. Control current $i_V$ is applied to a servo valve coil 52. Block 264 which may include resistors and filters as commonly recognized by persons of ordinary skill in the art establishes the feedback signal for amplifier 174. Variable resistance means 268 is coupled between one side of coil 52 and ground potential and sets the maximum value of control current $i_V$ permitted to flow in control loop 260.

The fast opening valve means of the present invention includes means for determining when further positional error signal e' exceeds a predetermined reference signal value. In this embodiment, positional error signal e' is supplied to an input of comparator 176. The other input of comparator 176 is provided with a reference voltage signal $V_{e'}$. Reference signal $V_{e'}$ is the opening error reference signal which can be set to sense the magnitude of further positional error signal e' at any predetermined level. In other words, the farther piston 12 of actuator 10 (FIG. 1) is away from the desired position to achieve appropriate steam flow demanded through the associated steam valve, the greater the positional error signal e'. When error signal e' equals or exceeds predetermined reference signal value $V_{e'}$, comparator 176 generates an output voltage signal to actuate coil 282 of relay KE. In this embodiment, only an opening error rate signal is critical, i.e., not a closing rate signal. Hence, comparator 176 only generates an output signal, herein a fast open command signal, when error signal e' is greater than a predetermined value. Contrariwise, if increasingly negative values of the error signal correspond to an opening rate signal, the comparator is appropriately configured to respond to negative values less than a predetermined value.

Means for comparing position feedback signal $E_F$ with a predetermined feedback reference signal $V_{EF}$ include a comparator 178 having one input supplied with position feedback signal $E_F$ and another input provided with predetermined feedback reference signal voltage $V_{EF}$. Comparator 178 generates a command signal, which is provided from the output of comparator 178 to the actuating coil 292 of relay KF, when position feedback signal $E_F$ is greater than feedback reference signal $V_{EF}$. In one embodiment, the feedback reference signal value $V_{EF}$ is set to be indicative of 50% of the total stroke of piston 12 of actuator 10 (FIG. 1).

FIGS. 3*a* and 3*b* schematically illustrate portions of relays K1, K2, KE and KF. It is to be recognized that relay KE includes coil 282 (FIG. 2) and a switching means 310, illustrated in FIG. 3*a*. Hence, when coil 282 of relay KE is activated, switching means 310 is closed. In this sense, when further positional error signal e' exceeds the opening error reference signal $V_{e'}$, a command signal from comparator 176 (FIG. 2) activates coil 282 of relay KE and switching means 310 of relay KE is closed. Similarly, when coil 292 (FIG. 2) of relay KF is activated by a command signal from comparator 178, a switching means 312 of relay KF is closed. Hence, the absence of a command signal voltage to coil 292 of relay KF isolates or counteracts the fast open command signal voltage supplied to coil 282 of relay KE by opening the activation path for activation coils 320 and 322 of relays K1 and K2, respectively. Absence of an energizing command signal voltage to coil 292 of relay KF is designated a positional stop command signal. An additional control may be added to the fast opening valve means in the form of switch means 314 which is closed upon actuation of a KARM system (not shown). The KARM system is not discussed in detail here since that system could be coupled to other control mechanisms in the turbine system or could be a manually operated on/off switch which enables the fast opening valve means discussed herein.

When switching means 310, 312 and 314 are closed, coils 320 and 322 of relays K1 and K2, respectively, are activated by application of an energization voltage designated as +24VDC to coils 320 and 322. The activation of coil 320 closes switch means 244 (FIG. 2) which changes the limit imposed by limit circuit 170. The activation of relay K2 by energization of coil 322 closes switch means 330 (FIG. 3*b*) of relay K2. Switch means 330 completes a circuit between an energization voltage source (herein at 115 volts AC) and ground potential to energize solenoid valve coil 130 (illustrated in FIG. 3*b* and in FIG. 1.) Therefore, the positional stop command signal i.e., relay KF deactivated, prohibits the fast open command signal from actuating solenoid valve 110. It is to be understood that any energization voltages may be used provided compatible components are selected for relays K1 and K2 and for switch means 310, 312, 314 and 330.

With reference in particular to FIG. 1, operation of one embodiment of the present invention is as follows. In this particular example, wherein actuator 10 is coupled to an intercept valve (not shown) for controlling steam flow, the intercept valve is commonly fully open. This open position is maintained by hydraulic fluid flow being delivered to chamber 18 of actuator 10 by servo valve 50. The amount of flow depends upon the magnitude of control current $i_V$, which in turn depends upon the voltage level of limited positional error signal $e_{LIMIT}'$. Error signal $e_{LIMIT}'$ is derived by limit circuit 170 as hereinbefore explained. Shutoff valve 64 is in the open position due to appropriate pressure applied to pilot 76 from FASV 134. Also, accumulator 80 is charged so that chamber 82 contains an auxiliary source of hydraulic fluid under pressure. In one embodiment, accumulator 80 has a 10 gallon capacity and the pressure of fluid on primary supply line 68 is 1600 psi. Of course, fluid in chamber 86 is at 1600 psi to balance out the force from fluid in chamber 82 which acts on sealing member 88. Hydraulic pressure on line 78 is maintained because the emergency close command signal is not provided to coil 148 whereby fast acting solenoid valve 134 is in a completely open position and hydraulic fluid from emergency trip supply 141 can flow through valve 134 to pilot 76. Hydraulic fluid also flows through valve 134 to chamber 36 of disc dump valve 28 to maintain disc 30 biased against port 32. Hence, hydraulic fluid pressure in line 40 maintains the open position of shutoff valve 64 as well as the closed or sealing position of disc 30 of disc dump valve 28. Solenoid valve 110 is completely closed because further positional error signal e' has not exceeded the value of opening error reference signal $V_{e'}$. Of course, the following scenario assumes switching means 314 (FIG. 3*a*) of the KARM system is closed. Also, it is assumed that position feedback signal $E_F$ has not exceeded the value of predetermined feedback reference signal $V_{EF}$.

As an example, it is assumed that the associated steam valve positioned by actuator 10 is first rapidly closed and then rapidly opened in accordance with this invention. In such a situation, an emergency close command signal (EVA) is supplied to coil 148 of FASV 134 causing FASV 134 to block fluid flow on hydraulic line 140 and to allow fluid communication between port 136 and port 142 of FASV 134, thereby connecting hydraulic line 40 to drain 146 of FASV 134. Pressure in hydraulic lines 40 and 78 as well as in chamber 36 is reduced, say from approxiamtely 1600 psi to 400 psi. Disc 30 of disc dump valve 28 is no longer biased against port 32 due to fluid pressure in chamber 18 of actuator 10 overcoming biasing pressure against disc 30, and hence port 32 is placed in fluid communication with drain 38 through circumferential discharge channel 37. Chamber 18 quickly empties its contents of hydraulic fluid into drain 38 causing piston 12 to translate toward the lower portion of actuator 10 and resulting in a corresponding closure of the associated steam valve. It is estimated that actuator 10 takes about 0.1 seconds to completely close the associated steam valve. Simultaneously, shutoff valve 64 prevents fluid from both fluid actuator supply 65 and auxiliary source 80 from flowing to servo valve 50.

During the early actuation sequence, steam flow demand signal $E_L$ remains constant. However, positional feedback signal $E_F$ changes due to the repositioning of piston 12 in valve actuator 10. Hence, positional error signal e increases. Relays KE and KF are activated, causing switching means 310 and 312 to close. Closure of switching means 310 and 312 also activates relays K1 and K2. Closure of switch means 330 of relay K2 activates coil 130 of solenoid valve 110 which causes valve 110 to open. Closure of switches 310, 312 and 330 corresponds to a fast open command signal. Closure of switch means 244 of relay K1 raises the limit imposed by limit circuit 170, i.e., substitutes a second limit magnitude for a first limit magnitude. However, shutoff valve 64 hydraulically isolates both servo valve 50 and solenoid valve 110 from fluid actuator supply 65 and auxiliary source 80.

When the emergency close command signal (EVA) voltage is removed from coil 148 of valve 134, the hydraulic fluid path through FASV 134 is opened and hydraulic pressure on line 40 is increased from approximately 0 to approximately 1600 psi. Thereafter, typically at about 800 psi, disc 30 of disc valve 28 is biased against port 32 and shutoff valve 64 reopens when sufficient hydraulic pressure is applied to pilot 76, allowing fluid flow from primary supply line 68 to hydraulic lines 56 and 114. The dwell time for valve actuator 10 is estimated to be 0.2 seconds. Thereafter, a combined flow of fluid from servo valve 50 and solenoid valve 110 enters chamber 18 through port 24 of actuator 10. To increase hydraulic fluid flow through servo valve 50, the maximum value of limited positional error signal $e_{LIMIT}'$ is permitted to increase by limiting circuit 170 in order to increase the fluid path through servo valve 50. Also, due to large fluid demand by actuator 10, fluid actuator supply FAS 65 generally cannot maintain adequate pressure at a juncture 116. Hence, accumulator 80, which is hydraulically coupled in close proximity to junction 116, supplies an auxiliary source of hydraulic fluid at a predetermined pressure during periods when large fluid flow is required due to opening the parallel hydraulic circuit through servo valve 50 and solenoid valve 110. Supply of auxiliary fluid by accumulator 80 reduces pressure transients in the hydraulic system. Further, the hydraulic attenuation of servo valve 50 remains constant regardless of the hydraulic fluid control position of solenoid valve 110. Also, the hydraulic loop attenuation for positioning piston 12 remains constant over the entire stroke of piston 12. As an added feature, when piston 12 reaches a predetermined position in its upward travel in chamber 18, the feedback position comparator 178 deactivates relay KF which in turn opens switch means 312, deactivates relays K1 and K2 and opens switch means 244 and switch 330. Hence, solenoid valve 110 closes thereby stopping hydraulic fluid through supplemental supply lines 114 and 120 and limited positional error signal $e_{LIMIT}'$ is limited to the first magnitude selected by limit circuit 170. This feature minimizes the velocity with which piston 12 strikes the upper portions of actuator 10. The predetermined position of piston 12 at which relay KF is deactivated to initiate the above described sequence of events may be selected by appropriately choosing the value of feedback reference signal $V_{EF}$ supplied to comparator 178.

It is to be understood that the term "flow of hydraulic fluid" and like terms not only mean a movement of hydraulic fluid along a hydraulic fluid path but also connote an uninterrupted hydraulic fluid path along which pressure from a source of hydraulic fluid to an application site of hydraulic fluid pressure may be transmitted through the hydraulic fluid.

Thus has been illustrated and described an apparatus and method for rapid opening of a valve actuator mechanically coupled to a steam valve and responsive to hydraulic fluid under pressure without significantly affecting the balance of the hydraulic fluid control system. The rapid opening feature may be combined with a fast opening feature of the actuator and may be effected with appropriate electronic circuitry and hydraulic control valves which are readily available.

While only certain preferred features of the invention have been shown by way of illustration, many modifications and changes will occur to those skilled in the art. It is to be understood that the appended claims are intended to cover all such modifications and changes as fall within the true spirit and scope of the invention.

What is claimed is:

1. A fast opening valve means for rapid actuation of a steam valve actuator, said valve actuator responding to hydraulic fluid supplied thereto from a source of hydraulic fluid through a control servo valve, and said valve actuator for positioning a valve stem of a steam valve in accordance with a control error signal supplied to said control servo valve, wherein the control error signal is representative of the difference between a demand control signal and a position feedback signal, the position feedback signal corresponding to the position of said valve actuator, said valve actuator for moving said valve stem to open said steam valve upon increased hydraulic fluid flow being supplied to said valve actuator, the fast opening valve means comprising:

means for generating a fast open command signal when said control error signal exceeds a predetermined reference signal value;

fast valve means hydraulically coupled in parallel with said control servo valve, said fast valve means for opening a supplemental hydraulic fluid supply line between said valve actuator and the source of hydraulic fluid in response to said fast open command signal, wherein the hydraulic attenuation of said control servo valve for a predetermined control position of said control servo valve remains constant regardless of the amount of hydraulic fluid flow in said supplemental hydraulic fluid supply line;

an auxiliary source of hydraulic fluid hydraulically coupled between the source of hydraulic fluid and said control servo valve and said fast valve means, said auxiliary source for substantially maintaining hydraulic fluid pressure upstream said control servo valve and said fast valve means during the opening of said supplemental hydraulic fluid supply line;

means for generating a positional stop command signal when the position feedback signal exceeds a predetermined feedback reference;

means for isolating said fast open command signal from said fast valve means in response to the positional stop command signal, thereby preventing opening the supplemental hydraulic fluid supply line;

means for limiting the control error signal corresponding to a demand control signal for opening the steam valve to a first magnitude; and means for substituting a second magnitude for said first magnitude when said fast open command signal is generated and during the interval that said positional stop command is not generated, said second magnitude being larger than said first magnitude.

2. A fast opening valve means as in claim 1 wherein said auxiliary source of hydraulic fluid is a fluid accumulator hydraulically coupled in close proximity to said juncture, and said fluid accumulator providing a secondary supply of hydraulic fluid under pressure to minimize pressure transients at said juncture caused by said opening of said supplemental fluid supply line.

3. A fast opening valve means as in claim 1 wherein said valve actuator includes:

a fast closing means for rapid positioning of said valve stem and steam valve to a closed position upon receipt of an emergency close command signal; and a shutoff valve hydraulically coupled between said juncture and said auxiliary source of hydraulic fluid, said shutoff valve prohibiting the flow of fluid therethrough only upon receipt of a signal corresponding to said emergency close command signal.

4. A fast opening valve means as in claim 1 wherein said valve actuator includes:

a fast closing means for rapid positioning of said valve stem and steam valve to a closed position upon receipt of an emergency close command signal; and a shutoff valve hydraulically coupled between said juncture and said auxiliary source of hydraulic fluid, said shutoff valve prohibiting the flow of fluid therethrough only upon receipt of a signal corresponding to said emergency close command signal.

5. A fast opening command means for rapid actuation of a valve actuator, said actuator responding to hydraulic fluid supplied to said actuator and said actuator operatively coupled to a steam flow control means for regulating steam flow of a steam turbine, comprising:

first hydraulic fluid control means in hydraulic flow communication with said actuator for continuously controlling flow of hydraulic fluid along a first hydraulic path to said actuator from a source of hydraulic fluid; and second hydraulic fluid control means in hydraulic flow communication with said actuator for controlling flow of hydraulic fluid along a second hydraulic path to said actuator from the source of hydraulic fluid, whereby the first hydraulic path and the second hydraulic path form a parallel hydraulic fluid route between the source of hydraulic fluid and said actuator;

wherein said first hydraulic fluid control means controls flow of hydraulic fluid to said actuator in response to a desired steam flow and to an actual steam flow of said turbine when the difference between the desired steam flow and the actual steam flow is less than a first predetermined value and controls flow of hydraulic fluid to said actuator in response to a first reference signal having a first predetermined magnitude when the difference between the desired steam flow and the actual steam flow is greater than the first predetermined value; and wherein said second hydraulic fluid control means controls flow of hydraulic fluid to said actuator in response to a fast open command signal; and said fast opening command means further comprising means for substituting a second reference signal having a second predetermined magnitude for the first reference signal in response to the fast open command signal when the steam flow control means is supplying less than a 6. A method for regulating an actual steam flow in a steam turbine, said steam turbine including steam flow control means for controlling said actual steam flow and an actuator operatively coupled to said steam flow control means for effecting continuous control of said actual steam flow, said actuator responsive to hydraulic fluid provided thereto, comprising:

supplying hydraulic fluid along a first hydraulic fluid path to said actuator in response to a demanded steam flow; and supplying hydraulic fluid along a second hydraulic fluid path to said actuator when the actual steam flow is less than the demanded steam flow, wherein said second hydraulic fluid path is in parallel with said first hydraulic fluid path;

limiting the amount of hydraulic fluid supplied along the second hydraulic path in response to a first predetermined magnitude when the actual steam flow is within a first predetermined value of maximum steam flow; and limiting the amount of hydraulic fluid supplied along the second hydraulic path in response to a second predetermined magnitude when the actual steam flow is within a second predetermined value of maximum steam flow, wherein a predetermined flow of hydraulic fluid is supplied along the first hydraulic fluid path at a constant hydraulic attenuation regardless of hydraulic fluid supplied along the second hydraulic fluid path.

* * * * *